US007621470B2

(12) United States Patent
Yamaguchi et al.

(10) Patent No.: US 7,621,470 B2
(45) Date of Patent: Nov. 24, 2009

(54) ELECTROSTATICALLY ATOMIZING DEVICE

(75) Inventors: Tomohiro Yamaguchi, Yasu (JP); Hiroshi Suda, Takatsuki (JP); Takayuki Nakada, Hirakata (JP); Tomonori Tanaka, Kasugai (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 395 days.

(21) Appl. No.: 10/583,913

(22) PCT Filed: Dec. 13, 2004

(86) PCT No.: PCT/JP2004/018557

§ 371 (c)(1),
(2), (4) Date: Jun. 21, 2006

(87) PCT Pub. No.: WO2005/061117

PCT Pub. Date: Jul. 7, 2005

(65) Prior Publication Data

US 2007/0119993 A1 May 31, 2007

(30) Foreign Application Priority Data

Dec. 22, 2003 (JP) ..... 2003-425045

(51) Int. Cl.
*B05B 5/00* (2006.01)

(52) U.S. Cl. ..... 239/690; 239/145; 239/326

(58) Field of Classification Search ..... 239/3, 239/145, 326, 690; 250/251, 288
See application file for complete search history.

(56) References Cited

U.S. PATENT DOCUMENTS

| | | | | |
|---|---|---|---|---|
| 3,296,491 | A * | 1/1967 | Brown | 239/3 |
| 4,476,515 | A * | 10/1984 | Coffee | 239/690 |
| 5,176,321 | A * | 1/1993 | Doherty | 239/690 |
| 5,337,963 | A | 8/1994 | Noakes | |
| 5,692,461 | A * | 12/1997 | Crovato et al. | 134/169 A |

FOREIGN PATENT DOCUMENTS

| | | |
|---|---|---|
| JP | 62-144774 | 6/1987 |
| JP | 6-511426 | 12/1994 |
| JP | 2001-286546 | 10/2001 |
| JP | 3260150 | 2/2002 |
| JP | 2002-203657 | 7/2002 |
| JP | 2003-14261 | 1/2003 |
| JP | 2003-079303 | 3/2003 |
| JP | 2003-79714 | 3/2003 |
| JP | 2003-322369 | 11/2003 |
| WO | WO-93/06937 | 4/1993 |

OTHER PUBLICATIONS

Japanese Office Action, Aug. 21, 2008, issued in JP2003-425045.

* cited by examiner

*Primary Examiner*—Steven J Ganey
(74) *Attorney, Agent, or Firm*—Edwards Angell Palmer & Dodge LLP

(57) ABSTRACT

Water is fed from a tank to a capillary carrier having an emitter end from which an ionized water particle is emitted by a voltage being applied across the emitter end and an opposed electrode. A cation exchanger is provided to remove minerals such as $Ca^{2+}$ and $Mg^{2+}$ from the water being fed through the capillary carrier or from the water to be fed to the carrier from the tank, thereby avoiding the ions from precipitating at the emitter end as $CaCO_3$ or MgO in reaction with $CO_2$ in the surrounding air, and therefore assure reliable electrostatic atomization over a long period of time.

6 Claims, 4 Drawing Sheets

ELECTROSTATICALLY ATOMIZING DEVICE

BACKGROUND OF THE INVENTION

1. Field of the Invention

The present invention relates to an electrostatic atomizing device for emitting water in the form of tiny ionized particles.

2. Description of the Related Art

Japanese Patent Publication JP 2001-286546 discloses a prior electrostatically atomizing device. The device includes a nozzle for atomization of water, an electrode disposed in close vicinity of a nozzle end to apply a high voltage across the nozzle and the electrode in order to transform the water into tiny ionized water particles. The device necessitates an atomizing mechanism for emitting the water from the nozzle.

Japanese Patent Publication JP 3260150 discloses another prior electrostatically atomizing device. The atomizing device utilizes a capillary structure made of a metal, glass or plastic material as a water carrier, in place of the atomizing structure, in order to feed the water towards an emitter end of the carrier by a capillary effect. A high voltage is applied to the emitter end so as to charge the water and emit the water in the form of ionized particles from the emitter end. When the water contains minerals such as Ca or Mg, the minerals will advance to the distal end of the capillary structure and react with $CO_2$ in the air to precipitate as $CaCO_3$ or MgO, which hinders the electrostatic atomization. Therefore, it has been a problem to require maintenance of removing the precipitants regularly.

SUMMARY OF THE INVENTION

[Problem to be Solved by the Invention]

The present invention has been achieved to overcome the above problem and to present an electrostatically atomizing device which utilizes a capillary structure as a water carrier but can avoid the precipitation of minerals at the emitter end of the carrier, thereby enabling stable electrostatically atomization over a long period of use.

[Means for Solving the Problem]

The electrostatically atomizing device of the present invention includes a capillary carrier having a water collecting end and an emitter end opposite of the water collecting end, the water collecting end collecting the water for feeding it to the emitter end. The device includes a first electrode for charging the water at the emitter end, and a second electrode opposed to the emitter end. The first and second electrodes are connected to a voltage source which applies a voltage across the first and second electrodes to charge the water at the emitter end and emit it in the form of tiny ionized particles. The characterizing feature of the present invention resides in the provision of a cation exchanger configured to remove mineral ions from the water being fed to the emitter end. Accordingly, when the water contains minerals such as Ca or Mg, the water can be fed to the emitter end by the capillary effect while being removed of minerals, preventing the minerals from precipitating at the emitter end. Accordingly, frequent cleaning of the emitter end can be avoided to keep the stable electrostatic atomization over a long period of use.

Preferably, the capillary carrier is made of a cation exchange material to define itself the cation exchanger. Thus, there is no need to add the cation exchanger, minimizing the number of assembly parts for improved productivity.

When the cation exchanger is added to the capillary carrier, it is preferred to fit around the capillary carrier at a portion upstream of the emitter end. With this arrangement, it is easy to remove the undesired minerals from the water advancing from the water collecting end to the emitter end through the capillary carrier, thereby effectively preventing the minerals from advancing to the emitter end.

Further, it is equally possible to provide the cation exchanger on the side of a tank. An auxiliary vessel is attached to the tank to contain the cation exchanger in contact with the water. In this case, the cation exchanger may be prepared in the form of a plurality of granules of ion exchange material, stacked sheets of the ion exchange material, or a spiral sheet of the ion exchange material.

These and still other advantageous features of the present invention will become more apparent from the following description of an embodiment when taken in conjunction with the attached drawings.

DETAILED DESCRIPTION OF EXEMPLARY EMBODIMENTS

Figure 1:
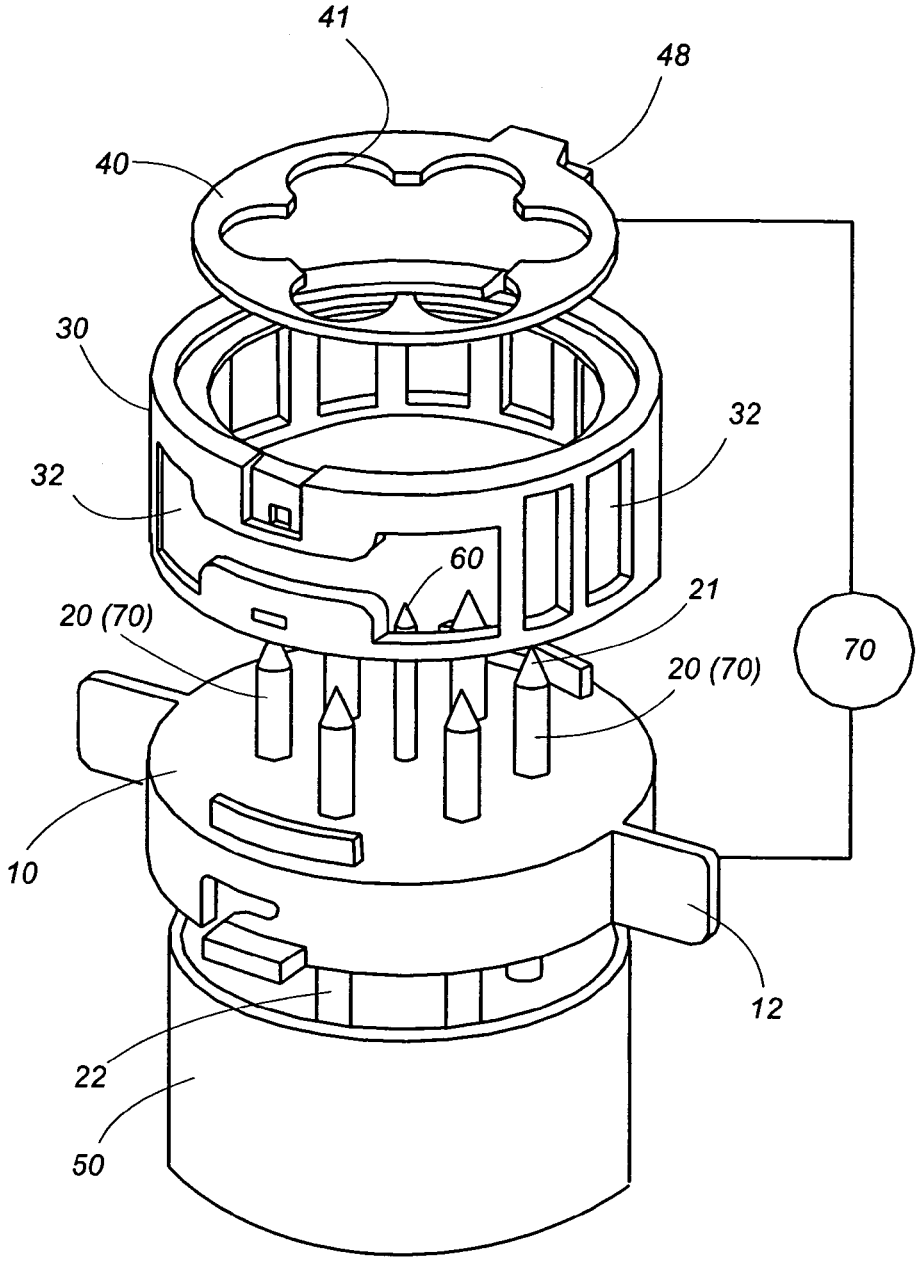
FIG. 1 is a perspective view of an electrostatically atomizing device in accordance with an embodiment of the present invention.
Figure 2:
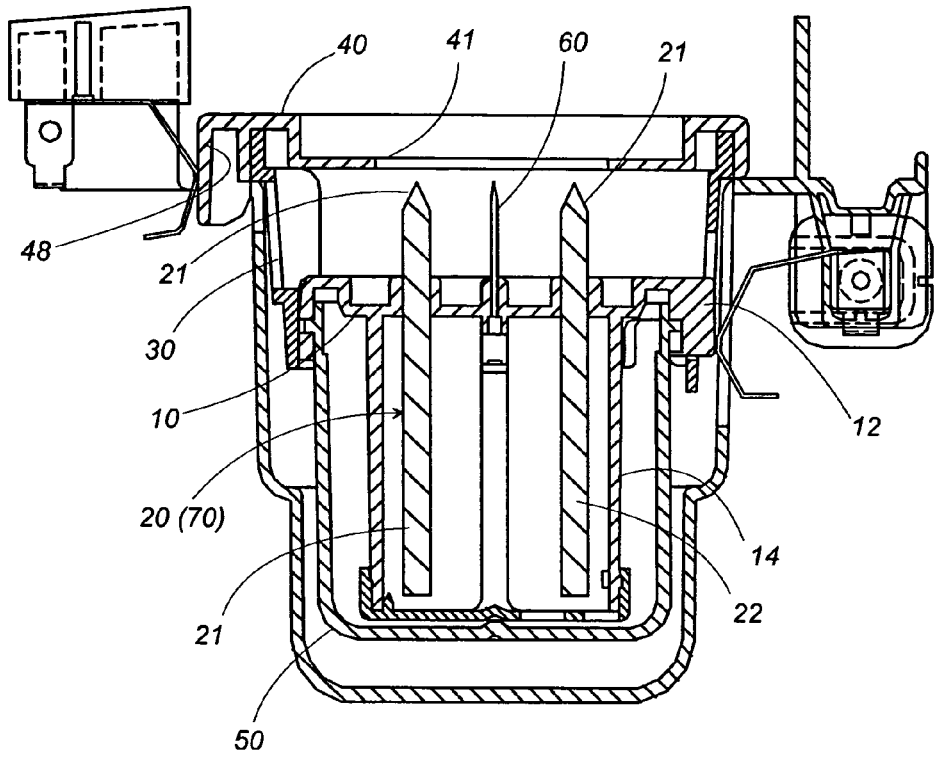
FIG. 2 is a vertical section of the above device.
Figure 3:
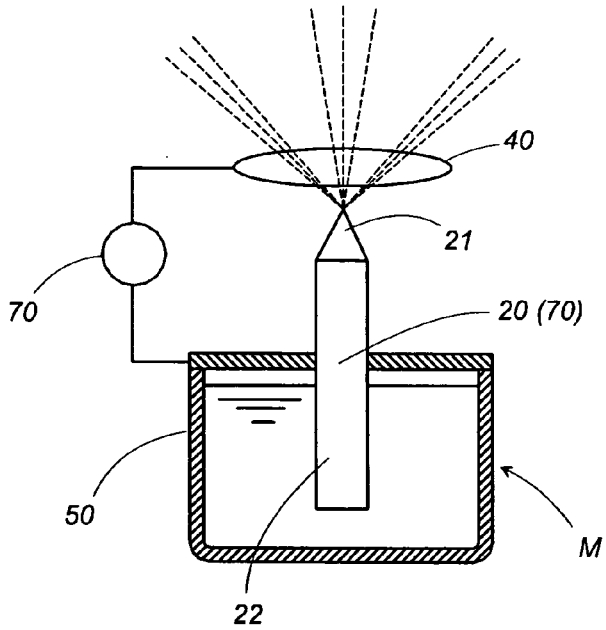
FIG. 3 is a schematic view illustrating the operation of the above device.

An electrostatically atomizing device in accordance with one embodiment of the present invention is designed to ionize particulate water so as to generate ionized water particles of a nanometer size. As shown in FIGS. 1 to 3, the electrostatically atomizing device includes a base 10 mounting a plurality of capillary carriers 20, a barrel 30 surrounding the top of the base 10, an electrode plate 40 fitted in a top opening of the barrel 30, and a tank 50 detachable to the lower end of the base 10. Each capillary carrier 20 is prepared in the form of a porous bar of 5 mm diameter and 70 mm length, and extends through the base 10. The top end of the capillary carrier 20 projecting above the base 10 is sharpened to define an emitter end 21, while the portion below the base 10 define a water collecting end 22. The water collecting end 22 is immersed in the water of the tank 50 to suck up the water and feed it to the emitter end 21 by the capillary action.

The base 10 is molded from an electrically conductive plastic material to define a first electrode which gives a certain electric potential to each of the capillary carriers 20. The base 10 is formed at its one circumferential portion with a terminal 12 for connection with a high voltage source 70. An electrode tube 14 extends from the lower side of the base 10 to charge the water to the same potential as the capillary carrier 20.

The high voltage source 70 is configured to apply the high voltage to give an electric field strength of 500 V/mm, for example, between the base 10 and the electrode plate 40, developing an electrostatic atomization between the emitter end 21 of the capillary carrier 20 and the electrode plate 40 defining the second electrode, such that tiny ionized water particles are emitted from the emitter end 21 towards the electrode plate 40. That is, the high voltage induces Rayleigh disintegration of the water being emitted from the emitter end 21, thereby generating negatively-charged water particles and emitting the mist of the tiny ionized water particles.

The electrode plate 40 is molded from an electrically conductive plastic material to have a circular circumference and to have a center opening with peripheral brim 41. The brim 41 is juxtaposed to the emitter end 21 of each capillary carrier 20 to enable an electric discharge between the brim 41 and the emitter end 21. The electrode plate 40 is formed at a portion on its circumference with a terminal 48 for connection with the high voltage source. The high voltage source applies continuous or pulsating high voltage across the electrode plate 40 and the base 10.

Figure 4:
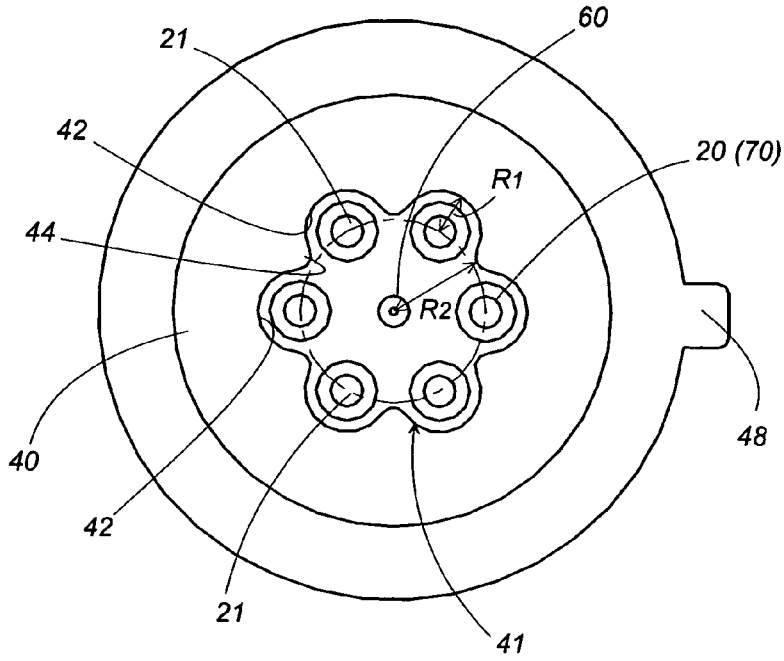
FIG. 4 is a top view of an electrode plate employed in the above device.

The base 10 supports at its center an ionizing needle 60 which has a pointed end projecting above the base 10 to the same height as the emitter end of the capillary carrier 20 and is electrically charged to the same potential as the capillary carriers 20. As shown in FIG. 4, the capillary carriers 20 are evenly spaced on a circumference of a circle concentric to the ionizing needle 60. The peripheral brim 41 of the electrode plate 40, which define an opposed electrode common to the capillary carrier 20 and the ionizing needle 60, is configured to have a plurality of continuous arc edges 42. Each of the arc edges 42 is curved into a semi-circular edge centered on the emitter end 21 of each capillary carrier 20 so as to be spaced from the emitter end by a constant distance. The adjacent arc edges 42 define therebetween a second edge 44 which is opposed to the ionizing needle 60 by a shortest distance in order to cause a corona discharge therebetween, thereby negatively charging molecules such as oxygen, oxide, or nitride in the air for generating negatively charged ions, while restraining the generation of ozone. That is, the distance R2 between the second edge 44 and the ionizing needle 60 is made greater than the distance R1 between the first arc edge 42 and the emitter end 21, enabling the atomization at the emitter end 21 and the generation of negatively charged ions at the ionizing needle 60 respectively at optimum conditions, while applying the same high negative voltage commonly to the ionizing needle 60 and the emitter end 21 of the capillary carrier 20.

The capillary carriers 20 is made of resin a fiber resin having cation exchange capability and is shaped into a porous body having a porosity of 10 to 70% in order to feed the water towards the emitter end 21 by the capillary effect using minute internal paths. The fiber resin having the cation exchange capability is fabricated from an ion exchange resin of a sodium ion exchange type or hydrogen ion exchange type. When using sodium ion exchange type, $Ca^{2+}$ and $Mg^{2+}$ contained in the water are exchanged by $Na^{+}$ and absorbed. When using hydrogen ion exchange type, $Ca^{2+}$ and $Mg^{2+}$ are exchanged by $H^{+}$ and absorbed. Thus, the capillary carrier 20 defines itself the cation exchanger 80 so that it can remove such minerals contained in the water while the water is being fed from the collecting end 22 to the emitter end 21. Consequently, the minerals can be well prevented from reaching the emitter end 21 of the capillary carrier 20, thereby being kept free from reacting with $CO_2$ in the surrounding air, and therefore being avoided from precipitating as MgO or $CaCO_3$, which would otherwise hinder the electrostatic atomization.

When the cation exchanger of the hydrogen ion exchange type is utilized, it is preferred to use an anion exchanger in combination in order to balance pH of the water. In this instance, the anion exchanger may be made of fiber to constitute a part of the capillary carrier 20 or may be provided separately from the capillary carrier 20 to be deposited in the tank 50. When the anion exchanger constitutes the part of the capillary carrier 20, it is located on the side of the emitter end 21.

Figure 5:
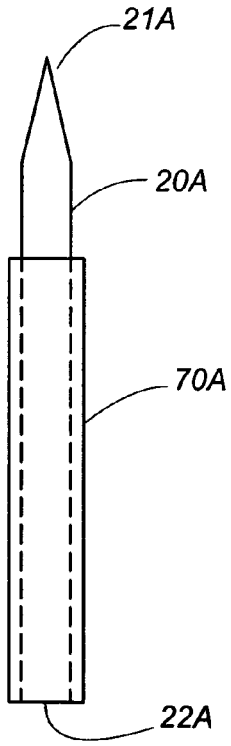
FIG. 5 is a front view of a modified capillary carrier utilized in the above device.

FIG. 5 illustrates a modification in which the cation exchanger 70A is provided separately from the capillary carrier 20A. In this case, the capillary carrier 20A is made of porous ceramic to have internal minute paths through which the water is fed towards the emitter end by the capillary effect. The ceramic is selected from one or any combination of alumina, titania, zirconia, silica, and magnesia. The cation exchanger 70A is made of the fiber resin and is shaped into a cylinder which surrounds closely around the capillary carrier 20A at a portion upstream of the emitter end 21A. Thus, the ion exchange is made to remove the minerals contained in the water advancing from the water collecting end 22A to the emitter end 21A.

The barrel 30 is formed in its circumferential wall with a plurality of openings 32 which introduce the air to cause the air flow being discharged from through the center opening of the electrode plate 40 such that the tiny ionized water particles generated between the emitter end 21 and the electrode plate 40 are carried on the air flow and spread in the form of a mist into a wide space.

When the mist of the tiny ionized water particles caused by the electrostatic atomization is being generated at a rate of 0.02 ml/m within an electric field strength of 500 V/mm or more with the use of the capillary carrier 20 of which tip diameter is 0.5 mm or below, the mist contains the very fine ionized particles having the nanometer particle size of 3 to 100 nm, which react with the oxygen in the air to give the radicals such as hydroxyl radicals, superoxides, nitrogen monoxide radicals, and oxygen radicals. The mist of the tiny ionized water particles, when released into a room, can deodorize substances contained in the air or adhered to the walls.

Figure 6:
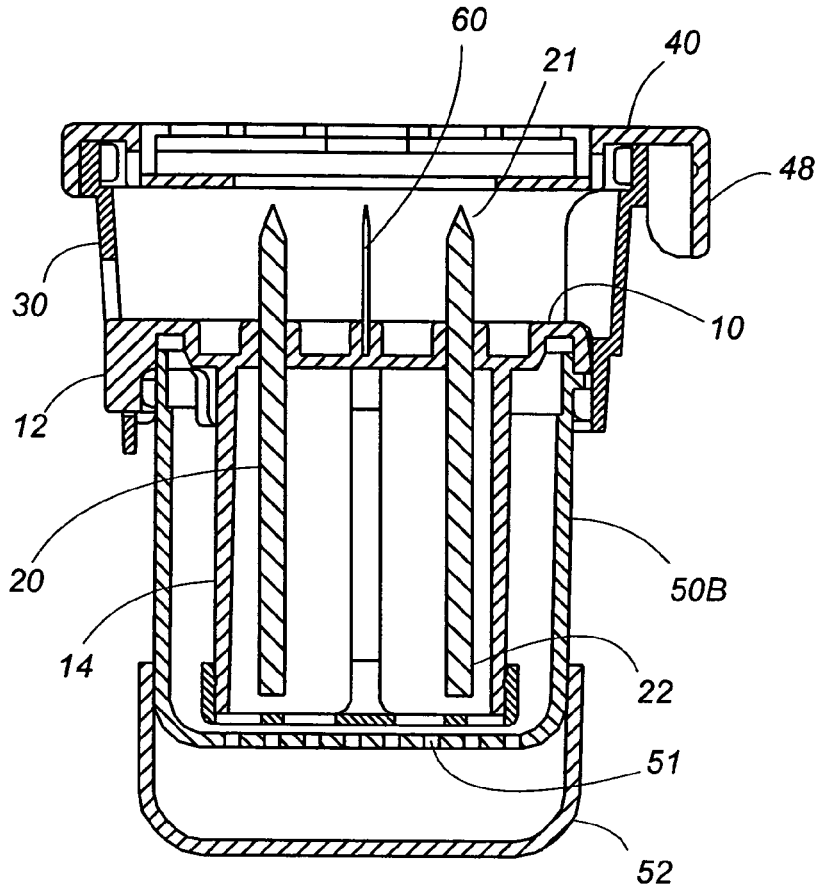
FIG. 6 is a vertical section of an electrostatically atomizing device in accordance with another embodiment of the present invention.
Figure 7:
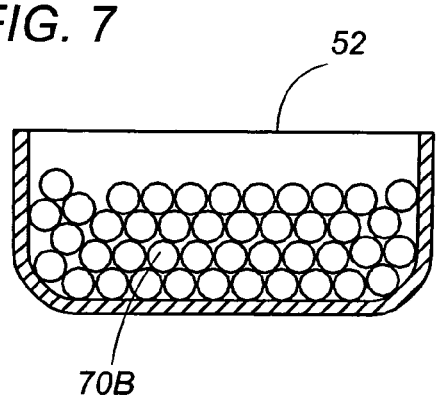
FIG. 7 is a sectional view of an auxiliary vessel containing a cation exchanger utilized in the above device.

FIG. 6 illustrates another embodiment in which an auxiliary vessel 52 is provided at the lower end of the tank 50 to contain the cation exchanger 70B. The other structures are identical to the above embodiment so that the same reference numerals apply to the same parts and no duplicate explanation is made herein. The auxiliary vessel 52 has a top opening which detachably receives the lower end of the tank 50B to take in the portion of the water through a plurality of holes 51 in the bottom of the tank 50B. As shown in FIG. 7, the cation exchanger 70B is prepared in the form of a plurality of granules made of the ion exchange resin to come into contact with the water in the auxiliary vessel 52. Thus, the cation exchanger 70B absorbs the minerals contained in the water within the tank, inhibiting the minerals from being fed to the capillary carrier 20 and therefore effectively preventing the precipitation of $CaCO_3$ or MgO at the emitter end MgO 21.

Figure 8:
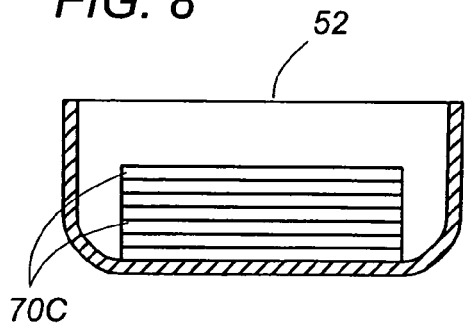
FIG. 8 is a sectional view of another cation exchanger contained in the auxiliary vessel utilized in the above device.
Figure 9:
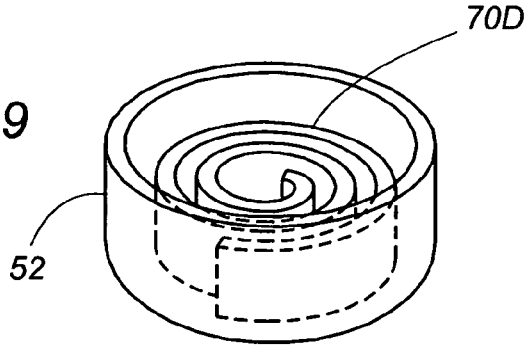
FIG. 9 is a perspective view of a further cation exchanger contained in the auxiliary vessel utilized in the above device.

The cation exchanger may be provided as a stack of plural sheets 70C as shown in FIG. 8, or as a spirally wound sheet 70D as shown in FIG. 9, to be accommodated within the auxiliary vessel 52. In this case, the fiber of ion exchange resin is used to fabricate a porous sheet which has an increased contact surface area with the water for improving the ion exchange capability.

As seen in the present embodiment where the cation exchanger is provided on the side of the tank 50B, the capillary carrier 20 is not necessarily made to have the cation exchange capability, and may be molded from a porous ceramic.

When the detachable auxiliary vessel 52 is utilized, it is easy to recycle the cation exchanger by detaching the vessel from the tank 50B. Also, since the tank 50B is detachable to the base 10, the cation exchanger may be contained in the tank 50B in contact with the water in the tank without relying upon the auxiliary vessel. In this case, the cation exchanger is preferred to be held in a net bag to be easily taken out of the tank.

The above embodiments and modifications are illustrated only for appropriately disclosing the present invention, and any combination of the features disclosed herein should be interpreted to be within the scope of the present invention.

The invention claimed is:

1. An electrostatically liquid atomizing device comprising:

a tank holding a volume of water;

a capillary carrier configured to have a water collecting end and an emitter end opposite of said water collecting end, said water collecting end collecting the water for feeding it through said carrier to said emitter end, a first electrode electrically charging said water at said emitter end, a second electrode opposed to said emitter end, said first electrode and said second electrode being configured to be connected to a voltage source, said voltage source applying a voltage across said first and second electrodes to thereby electrostatically charge the water at said emitter end and emit the said water in the form of tiny ionized particles, said device including a cation exchanger configured to remove mineral ions from said water, wherein said capillary carrier is made of a cation exchange material to define itself as said cation exchanger.

2. The electrostatically liquid atomizing device comprising:

a tank holding a volume of water;

a capillary carrier configured to have a water collecting end and an emitter end opposite of said water collecting end, said water collecting end collecting the water for feeding it through said carrier to said emitter end, a first electrode electrically charging said water at said emitter end, a second electrode opposed to said emitter end, said first electrode and said second electrode being configured to be connected to a voltage source, said voltage source applying a voltage across said first and second electrodes to thereby electrostatically charge the water at said emitter end and emit the said water in the form of tiny ionized particles, said device including a cation exchanger configured to remove mineral ions from said water, wherein said cation exchanger is fitted around said capillary carrier at a portion upstream of said emitter end.

3. An electrostatically liquid atomizing device comprising:

a tank holding a volume of water;

a capillary carrier configured to have a water collecting end and an emitter end formed into a single pointed end shape opposite of said water collecting end, said water collecting end collecting the water for feeding it through said carrier to said emitter end;

a first electrode electrically charging said water at said emitter end; and a second electrode opposed to said emitter end, wherein said first electrode and said second electrode are configured to be connected to a voltage source, said voltage source applying such a voltage across said first and second electrodes to thereby electrostatically charge the water at said emitter end and emit the said water in the form of tiny ionized particles of a nanometer size, said device including a cation exchanger configured to remove mineral ions from said water, and said device further including an auxiliary vessel which is attached to said tank and is configured to contain said cation exchanger in contact with said water.

4. An electrostatically liquid atomizing device comprising:

a tank holding a volume of water;

a capillary carrier configured to have a water collecting end and an emitter end opposite of said water collecting end, said water collecting end collecting the water for feeding it through said carrier to said emitter end, a first electrode electrically charging said water at said emitter end, a second electrode opposed to said emitter end, said first electrode and said second electrode being configured to be connected to a voltage source, said voltage source applying a voltage across said first and second electrodes to thereby electrostatically charge the water at said emitter end and emit the said water in the form of tiny ionized particles, said device including a cation exchanger configured to remove mineral ions from said water, and an auxiliary vessel which is attached to said tank and is configured to contain said cation exchanger in contact with said water, wherein said cation exchanger comprises a plurality of granules made of a cation exchange material.

5. An electrostatically liquid atomizing device comprising:

a tank holding a volume of water;

a capillary carrier configured to have a water collecting end and an emitter end opposite of said water collecting end, said water collecting end collecting the water for feeding it through said carrier to said emitter end, a first electrode electrically charging said water at said emitter end, a second electrode opposed to said emitter end, said first electrode and said second electrode being configured to be connected to a voltage source, said voltage source applying a voltage across said first and second electrodes to thereby electrostatically charge the water at said emitter end and emit the said water in the form of tiny ionized particles, said device including a cation exchanger configured to remove mineral ions from said water, and an auxiliary vessel which is attached to said tank and is configured to contain said cation exchanger in contact with said water, wherein said cation exchanger comprises a stack of plural sheets made of a cation exchange material.

6. An electrostatically liquid atomizing device comprising:

a tank holding a volume of water;

a capillary carrier configured to have a water collecting end and an emitter end opposite of said water collecting end, said water collecting end collecting the water for feeding it through said carrier to said emitter end, a first electrode electrically charging said water at said emitter end, a second electrode opposed to said emitter end, said first electrode and said second electrode being configured to be connected to a voltage source, said voltage source applying a voltage across said first and second electrodes to thereby electrostatically charge the water at said emitter end and emit the said water in the form of tiny ionized particles, said device including a cation exchanger configured to remove mineral ions from said water, and an auxiliary vessel which is attached to said tank and is configured to contain said cation exchanger in contact with said water, wherein said cation exchanger is a spiral sheet made of a cation exchange material.

* * * * *